US005194835A

United States Patent [19]

Destrade

[11] Patent Number: 5,194,835

[45] Date of Patent: Mar. 16, 1993

[54] ENERGY COUPLING DEVICE

[75] Inventor: Michel Destrade, Domont, France

[73] Assignee: Thomson-LGT Laboratoire General des Telecommunications, Conflans Ste Honorine, France

[21] Appl. No.: 815,849

[22] Filed: Dec. 31, 1991

Related U.S. Application Data

[63] Continuation of Ser. No. 549,242, Jul. 9, 1990, abandoned, which is a continuation of Ser. No. 284,612, Dec. 15, 1988, abandoned.

[30] Foreign Application Priority Data

Dec. 18, 1987 [FR] France ..... 62-17710

[51] Int. Cl.[5] ..... H01P 5/18

[52] U.S. Cl. ..... 333/109; 333/117

[58] Field of Search ..... 333/109, 115, 116, 117

[56] References Cited

U.S. PATENT DOCUMENTS 4,673,898 6/1987 Redmond ..... 333/109

*Primary Examiner*—Paul Gensler

*Attorney, Agent, or Firm*—Oblon, Spivak, McClelland, Maier & Neustadt

[57] ABSTRACT

Disclosed is an energy coupling device which can be used with metrical and decimetrical waves. To distribute, equipotentially and in equiphase, towards n users, the energy coming from m equipotential sources in equiphase, a 90-degree of 3 dB hybrid circuit is connected at the output of each source. This circuit distributes the power equally and with a 90-degree, aperiodic phase shift, towards two equipotential distributors in equiphase, with m inputs and n outputs, having one and the same input/output phase shift. The two distributors are connected, respectively, to the two ports of a pair of conjugated ports of n 90-degree 3 dB hybrid circuits. The powers recombined in these n circuits are respectively delivered to n users.

1 Claim, 3 Drawing Sheets

ENERGY COUPLING DEVICE

This application is a continuation of application Ser. No. 07/549,242, filed on Jul. 9, 1990, now abandoned, which is a continuation of application Ser. No. 07/284,612, filed Dec. 15, 1988, abandoned.

BACKGROUND OF THE INVENTION

1. Field of the Invention

An object of the present invention is a device for the coupling of energies, which can be used with metrical and decimetrical waves.

Devices of this type are necessary in different cases: for example, using a source, to make several amplifiers or preamplifiers working equipotentially and in equiphase, or else to summate the powers delivered by several equipotential and equiphase preamplifiers so that, with the power obtained, amplifiers are made to work equipotentially and in equiphase, or else again to summate the powers delivered by several amplifiers working equipotentially and in equiphase to supply one and the same user, generally formed by a sending antenna.

2. Description of the Prior Art

In the case, for example, of amplifiers which are to be made to work equipotentially and in equiphase, there are distributors with one input and n outputs, associated with impedance matching circuits by quarter-wavelength transformers, which perform this operation accurately inasmuch as all the amplifiers deliver the same power; but if one or more amplifiers break down, the resultant mismatching disturbs, notably, the operation of the entire assembly, and it becomes necessary to shield the amplifiers by means of insulation devices. Various solutions have been used to achieve this purpose:

distributors have been associated with circulator-type insulator devices using the gyromagnetic properties of ferrites. This approach is theoretically an ideal one, but, in practice, it has various drawbacks, such as limitations on power and selectivity, and relatively high losses in the circulators;

ring-type hybrid junctions, 3 dB couplers etc. have been cascade-mounted, the amplifiers being connected, in twos, to one and the same junction; excellent decoupling is thus achieved between the amplifiers but this is a costly approach, especially for a large number of amplifiers, because of the number of hybrid junctions needed. Moreover, the losses are high;

distributors have been associated with Wilkinson type shielding devices; this is a fairly efficient approach. However, it has proved to be very difficult to apply it for use with microwave bands with a large number of amplifiers.

SUMMARY OF THE INVENTION

An aim of the invention is to obtain the same advantages as those related to cascade-mounted hybrid junctions while, at the same time, reducing the drawbacks to a minimum.

This is got by suitably associating hybrid junctions with distributors.

According to the invention, there is provided a device for the coupling of energies, between m energy sources, where m is a positive whole-number value, and n users, where n is a positive whole-number value, and where m+n is greater than 2, comprising m first and n second 90-degree, 3 dB hybrid circuits, each having a first, a second, a third and a fourth port, the first and the second ports as well as the third and the fourth ports of each hybrid circuit forming pairs of conjugated ports, m+n balancing loads respectively associated with the m+n hybrid circuits and a first and a second distributor with the m inputs n outputs, the two distributors being equipotential and in equiphase, and having the same inputs/outputs phase shift, the m first circuits having their m first inputs coupled respectively to the m sources, their n second ports connected respectively to the m loads, their m third ports connected, respectively, to the m inputs of the first distributor, their m fourth ports connected, respectively, to the m inputs of the second distributor, the n second circuits having their n first ports respectively connected to the n outputs of the first distributor, their n second ports respectively connected to the n outputs of the second distributor, their n third ports respectively connected to the n loads and their n fourth ports respectively connected to the n users.

BRIEF DESCRIPTION OF THE DRAWINGS

The present invention will be better understood, and its other characteristics will emerge, from the following description and the appended figures, of which.

The corresponding elements in the various figures are designated by the same references.

MORE DETAILED DESCRIPTION

In the following description, as well as in the claims, reference is made to 90-degree 3B hybrid junctions, comprising two pairs of conjugated ports. The term "pair of conjugated ports" of the junction must be understood to mean two of the four ports of the junction such that, if the matched loads are connected to it, there is practically no coupling between the other two ports of the circuit, the other two ports moreover forming also a pair of conjugated ports; and always when matched loads are connected to one of the pairs of conjugated ports, the power applied to one of the two conjugated ports of the other pair goes out by the ports of the pair to which matched loads are connected, at equal power but with waves in phase quadrature. In the diagrams, the pairs of conjugated ports of the 90-degree 3 dB hybrid junctions, shall be respectively marked 1–2 and 3–4; these junctions are directional couplers in the assemblies which have been used as examples for the present description, and these 90-degree 3 dB directional couplers, shall be called, in the rest of the description "3 dB couplers" or even "couplers". However, it should be noted that, without going beyond the scope of the invention, these couplers may consist of any other equivalent junctions such as, for example, magic T junctions or hybrid ring junctions associated with phase shift elements of appropriate value.

Figure 1:
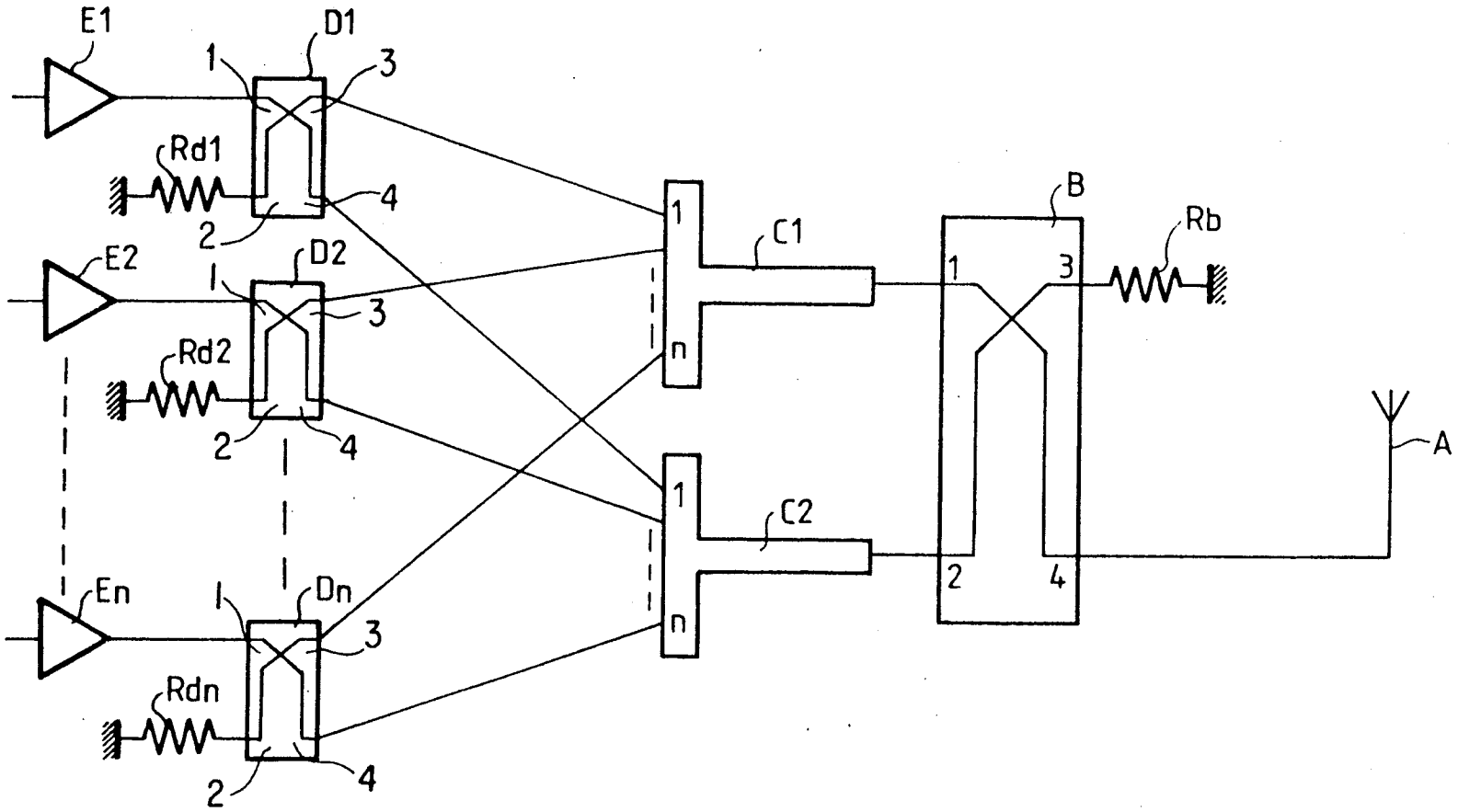
FIG. 1 shows a coupling device between amplifiers and a user.

FIG. 1 shows the diagram of a coupling device which can be used to supply an antenna A with the sum, short of losses, of the energies given by n amplifiers, El to En (in the example described n was equal to 8 and the amplifiers each had an output power of 1 kilowatt). The outputs of the amplifiers, El to En, are respectively connected to the ports 1 of n 3 dB couplers, Dl to Dn.

Between the ports 2 of the couplers Dl to Dn and the ground, there are mounted the balancing resistors Rdl to Rdn which form matched loads. The ports 3 of the couplers Dl to Dn are respectively connected to the inputs 1 to n of a distributor Cl with n inputs and one output. In the same way, the ports 4 of the couplers Dl to Dn are respectively connected to the inputs 1 to n of a distributor C2 with n inputs and one output; the distributors Cl, C2, are equipotential and in equiphase, and have the same input/output phase shift. These distributors are also called 0° dividers. The outputs of the distributors C1, C2, are respectively connected to the ports 1 and 2 of a 3 dB coupler, B, the port 3 of which is connected to the ground by a balancing resistor Rb and the port 4 of which is connected to the antenna A, the latter having an impedance matching circuit (not shown).

Figure 2:
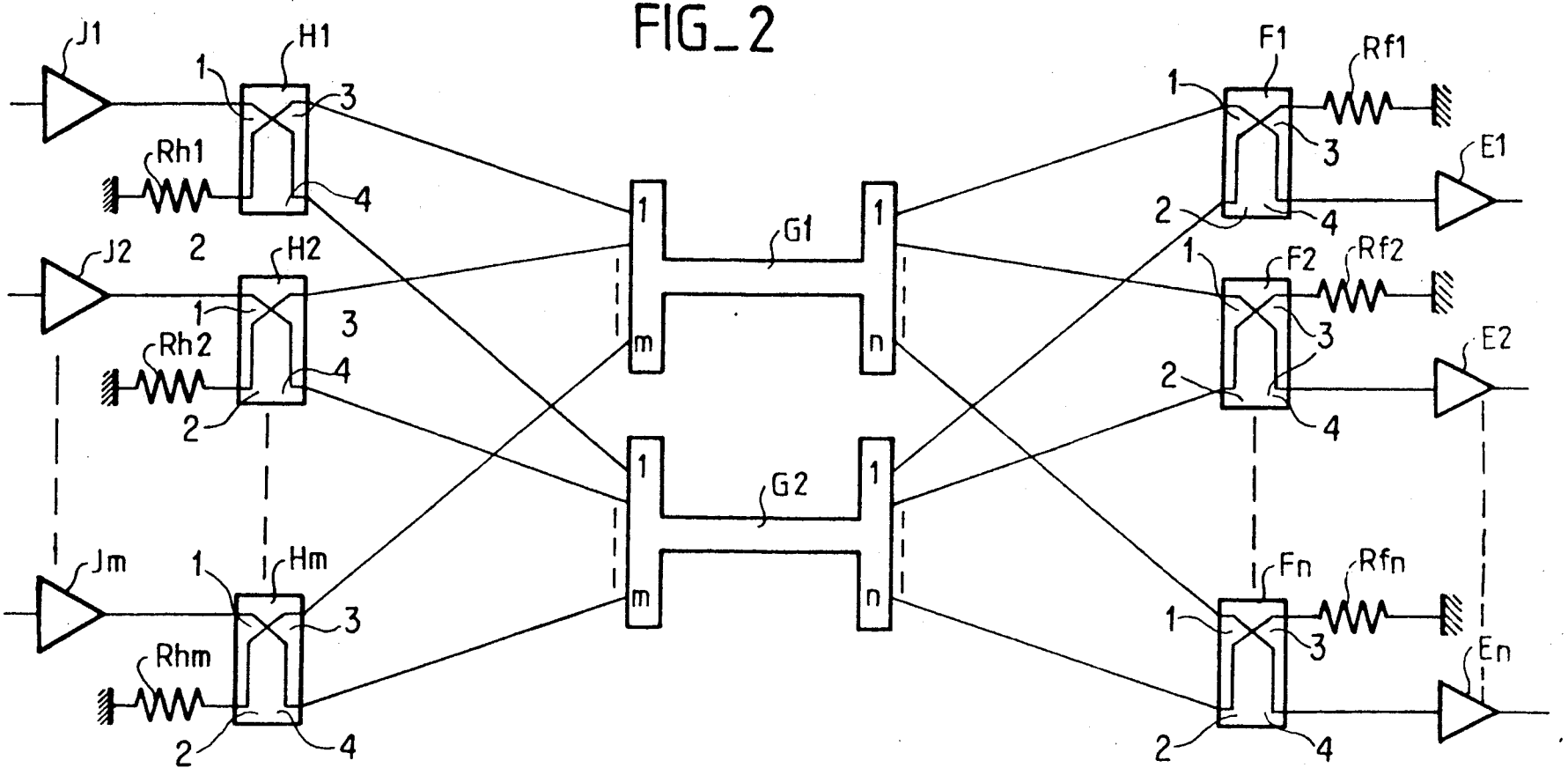
FIG. 2 shows a coupling device between preamplifiers and the amplifiers of FIG. 1.
Figure 3:
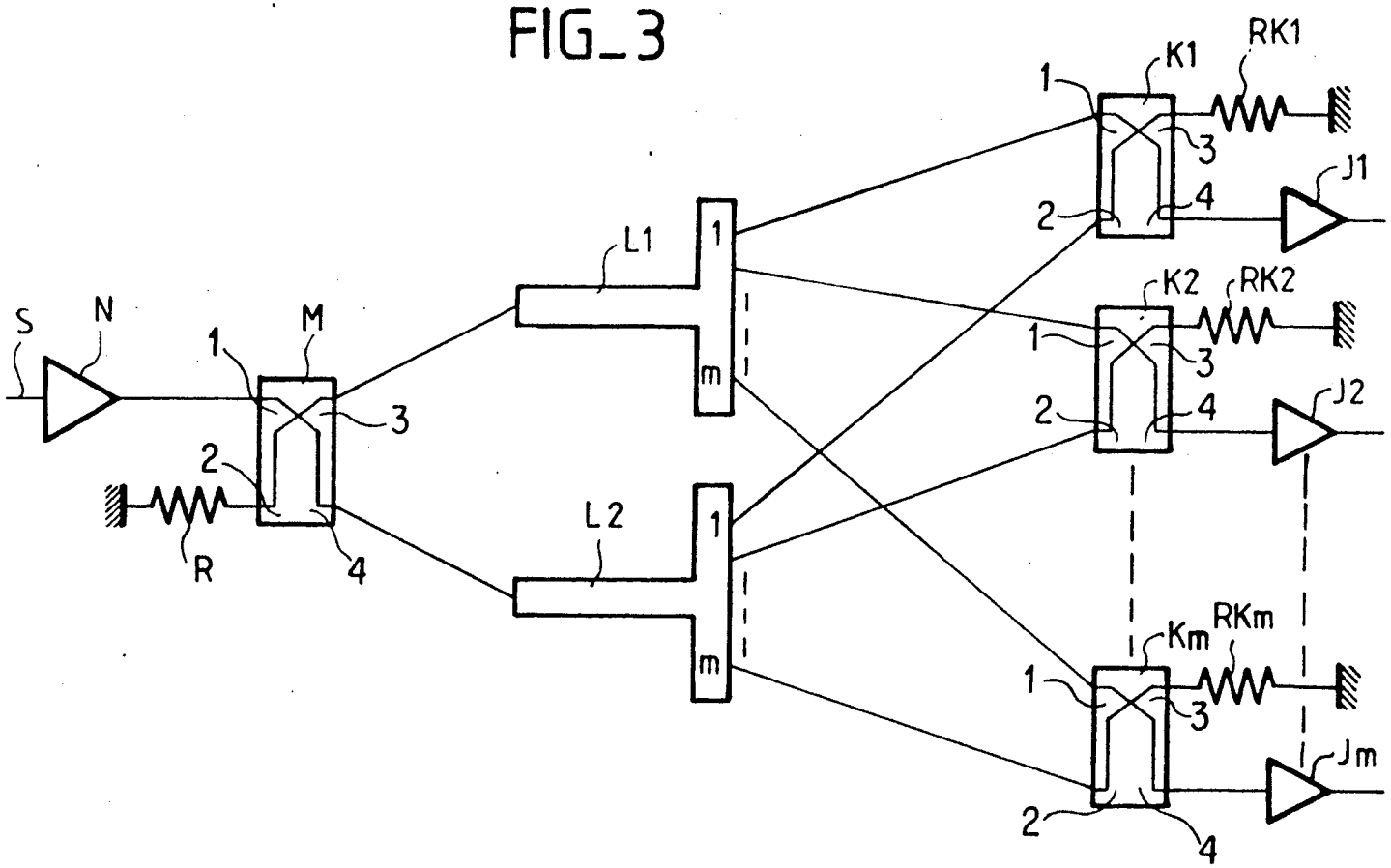
FIG. 3 shows a coupling device between a source and the preamplifiers of FIG. 2.

If the assembly according to FIG. 1 is to work accurately, the amplifiers El to En should deliver equipotential and equiphase signals; there are known assemblies to obtain this result, but it is also possible, as shall be seen with the help of FIGS. 2 and 3, to achieve this result with asssemblies according to the invention, since what has to be done, each time, is to distribute the power of one or more sources to one or more users which become sources in the next amplification step; thus, the amplifiers of FIG. 1, which are the users of energy from the preamplifiers of FIG. 2, are also the energy sources for the user which is the antenna A of FIG. 1.

In normal operation, namely with the amplifiers El to En, delivering equipotential signals in equiphase, the power of the amplifier Ei (i: whole number which may assume any value from 1 to n) is divided into two equal parts, but with a 90° a periodic phase shift, by the coupler Di:

a part $U/\sqrt{2}$ which appears on the port 3 of the coupler Di (U being the voltage corresponding to the power given by the amplifier Di which, besides, is the same irrespectively of the value assumed by i from 1 to n);

a part $U/\sqrt{2}.\exp(-j\pi/2)$, where $\exp(-j\pi/2)$ represents the exponential of $-j\pi/2$, with $j=\sqrt{-1}$;

all the power of the signals appearing at the port 3 of the couplers Dl to Dn is applied to the distributor Cl, and all the power of the signals appearing at the port 4 of the couplers Dl to Dn is applied to the distributor C2. If $\phi c$ is the phase change resulting from the crossing of the distributors C1 and C2, the signals at the ports 1 and 2 of the coupler B respectively have the form:

$$U/\sqrt{2}\ .\exp(j\phi c).$$

$$U/\sqrt{2}\ .\exp - j(\pi/2 - \phi c)$$

giving respectively at the ports 3 and 4 of the coupler B, $U/2.\exp(j\phi c)+U/2.\exp\text{-}j(\pi\text{-}\phi c)$, a null signal, and $U/2.\exp-j(\pi/2\text{-}\phi c)+U/2.\exp-j(\pi/2\text{-}\phi c)$, a signal representing the recombined total power.

Thus, the assembly formed by the couplers and the distributors of FIG. 1, constitutes a shunting of the ports 1 of the couplers, Dl to Dn, towards the port 4 of the coupler B when the ports 2 of the couplers, Dl to Dn, and the port 3 of the coupler B are perfectly decoupled. The assembly according to FIG. 1 works as a power summator, the power at the port 4 of the coupler B being the sum, short of losses, of the powers given by the amplifiers El to En. It should be further noted that the assembly according to figure is reversible, except for the amplifiers El to En.

However, what is the degree of isolation of the amplifiers El to En with respect to one another? The signal that comes from an amplifier Ei (i: whole number capable of assuming any value from 1 to n) and has reached the inputs i of the dividers Cl and C2 is divided into three parts:

one part transmitted towards the ports 1 and 2 of the coupler B;

one part reflected towards the amplifier Ei;

one part retransmitted towards the other amplifiers;

When all the signals given by the amplifiers El to En are equipotential and in equiphase, only that part transmitted towards the ports 1 and 2 of the coupler B exists, while the other parts are null. When this is not the case owing to an imbalance in amplitude or phase between the amplifiers, or owing to a failure of one or more amplifiers, any signal coming from a faulty amplifier Ei and reflected by the distributors Cl and C2, or retransmitted to the other amplifiers, gets recombined and appears at the ports 2 of the couplers Dl to Dn where it is absorbed by the protective loads formed by balancing resistors Rdl to Rdn. The assembly according to FIG. 1 thus provides perfect protection to the amplifiers from any imbalance and even from any total stoppage of one or more amplifiers. And the ratio between the normally available total power and the effectively available total power is, barring losses of the system, as for an association of cascade-mounted couplers;

$n^2/(n-n')^2$ where n' is the number of malfunctioning amplifiers.

FIG. 2 shows how the n amplifiers El and En are supplied from m equipotential and equiphase preamplifiers, Jl to Jm. The assembly comprises the m preamplifiers, followed by m 90-degree 3 dB couplers, Hl to Hm, followed by two identical equipotential and equiphase distributors Gl and G2 with m inputs and n outputs followed by n 90-degree 3dB couplers, Fl to Fn, followed by n amplifiers, El to En. Between the ports 2 of the couplers, Hl to Hm, and the ground as well as between the ports 3 of the couplers Fl to Fn and the ground, there are connected balancing resistors, Rhl to Rhm and Rfl to Rfn.

That part of the assembly of FIG. 2, going from the preamplifiers, Jl to Jn, to the inputs of the distributors Gl, G2, corresponds to that part of the assembly according to FIG. 1, included between the amplifiers, El to En, and the inputs of the distributors Cl and C2; the shielding of the preamplifiers, Jl to Jn, against any abnormal operation by one of them is thus provided.

That part of the assembly of FIG. 2, going from the outputs of the distributors, Gl, G2, to the inputs of the amplifiers, El to En, corresponds to that part of the assembly according to FIG. 1 between the inputs of the distributors, Cl and C2, and the outputs of the amplifiers, E1 to En, namely a part used in reverse to the direction of its use according to FIG. 1, in taking advantage of its reversibility. This part of the assembly of FIG. 2 enables an equipotential and equiphase supply of the amplifiers El to En.

FIG. 3 shows how the preamplifiers, Jl to Jn, can be supplied equipotentially and in equiphase from a source represented by a single amplifier, N, to the input of which a signal S is applied. The assembly has the amplifier N, followed by a 90-degree 3dB coupler, M, followed by two identical, equipotential and equiphase distributors L1, L2, with one input and m outputs, followed by m 90-degree 3 dB couplers, Kl to Km, followed by m preamplifiers, Jl to Jm. Between the port 2 of the coupler M and the ground, as well as between the ports 3 of the couplers Kl to Km and the ground, balancing resistors R and Rkl to Rkm are connected.

That part of the assembly according to FIG. 3, included between the output of the source N and the inputs of the preamplifiers Jl to Jm, corresponds to that part of the assembly according to FIG. 1 included between the antenna A and the outputs of the amplifiers, El to En, which is used, therefore, through its reversibility, in the reverse direction of its use according to FIG. 1. This assembly can be used .for an equipotential and equiphase supply of the preamplifiers, Jl to Jm.

The invention is not restricted to the example described. It can be applied generally to the equipotential and equiphase supply of n users by m sources of energy with m and n as positive whole numbers and m+n as greater than 2.

What is claimed is:

1. A device for the coupling of energies, between m energy sources, wherein the m energy sources are equipotential and in equiphase and where m is a positive whole-number value, and n users, where n is a positive whole-number value, and where m+n is greater than 2, for delivering equipotential and equiphase energy to the n users, comprising:

m first and n second 90-degree, 3 dB hybrid circuits, each having a respective first, a second, a third and a fourth port, the first and the second ports as well as the third and the fourth ports of each hybrid circuit forming pairs of conjugated ports;

m+n balancing loads respectively associated with the m+n hybrid circuits;

a first and a second distributor each with m inputs and n outputs, the two distributors being equipotential and in equiphase, and having the same inputs/outputs phase shift;

the m first circuits having their m first ports coupled respectively to the m sources, their m second ports connected respectively to the m loads, their m third ports connected respectively to the m inputs of the first distributor, their m fourth ports connected respectively to the m inputs of the second distributor; and the n second circuits having their n first ports respectively connected to the n outputs of the first distributor, their n second ports respectively directly connected to the n outputs of the second distributor, their n third ports respectively connected to the n loads and their n fourth ports respectively connected to the n users.

* * * * *